US005636874A

United States Patent [19]

Singer

[11] Patent Number: 5,636,874

[45] Date of Patent: Jun. 10, 1997

[54] TEMPERATURE SENSITIVE SECURITY DOCUMENT

[75] Inventor: Stephen A. Singer, Wheeling, Ill.

[73] Assignee: Micro Format, Inc., Wheeling, Ill.

[21] Appl. No.: 492,771

[22] Filed: Jun. 21, 1995

Related U.S. Application Data

[63] Continuation of Ser. No. 223,285, Apr. 5, 1994, abandoned.

[51] Int. Cl.[6] ..... B42D 15/10

[52] U.S. Cl. ..... 283/94; 283/95; 283/114; 283/57; 283/58; 283/901; 283/902

[58] Field of Search ..... 283/93, 94, 95, 283/72, 114, 74, 57, 58, 51, 901, 902; 428/916

[56] References Cited

U.S. PATENT DOCUMENTS

| | | | |
|---|---|---|---|
| 3,702,920 | 11/1972 | Taylor | 283/71 X |
| 4,168,088 | 9/1979 | Somlyody . | |
| 4,210,346 | 7/1980 | Mowry, Jr. et al. . | |
| 4,227,719 | 10/1980 | McElligott et al. . | |
| 4,227,720 | 10/1980 | Mowry, Jr. et al. . | |
| 4,265,469 | 5/1981 | Mowry, Jr. et al. . | |
| 4,310,180 | 1/1982 | Mowry, Jr. et al. . | |
| 4,341,404 | 7/1982 | Mowry, Jr. et al. . | |
| 4,351,547 | 9/1982 | Brooks, II . | |
| 4,407,443 | 10/1983 | McCorkle | 283/94 X |
| 4,420,175 | 12/1983 | Mowry, Jr. . | |
| 4,462,039 | 7/1984 | Small et al. . | |
| 4,511,908 | 4/1985 | Small . | |
| 4,579,370 | 4/1986 | Corwin et al. . | |
| 4,869,941 | 9/1989 | Ohki | 283/74 X |
| 5,074,566 | 12/1991 | Desbiens . | |
| 5,171,040 | 12/1992 | Orndorff . | |
| 5,193,854 | 3/1993 | Borowski, Jr. et al. . | |
| 5,344,191 | 9/1994 | Chang et al. | 283/904 X |
| 5,401,060 | 3/1995 | Chang et al. | 283/114 X |
| 5,427,415 | 6/1995 | Chang | 283/902 X |
| 5,524,934 | 6/1996 | Schwan et al. | 283/901 X |

*Primary Examiner*—Frances Han

*Attorney, Agent, or Firm*—Marshall, O'Toole, Gerstein, Murray & Borun

[57] ABSTRACT

To prevent unauthorized duplication of important security documents, an improvement in security or protected documents is disclosed. The security document includes a substrate having top and bottom surfaces where at least one of the surfaces is adapted to carry printed copy thereon. A colored background is printed on at least a portion of one of the surfaces, such as the surface which is adapted to carry printed copy, using a temperature sensitive ink. The security document also includes copy printed on at least a portion of the one of the surfaces adapted to carry printed copy thereon. With these features of construction, the security or protected document contemplates the copy being printed by utilizing a temperature insensitive ink.

19 Claims, 1 Drawing Sheet

TEMPERATURE SENSITIVE SECURITY DOCUMENT

This is a Rule 62 file wrapper continuation of U.S. application Ser. No. 08/223,285, filed Apr. 5, 1994, now abandoned.

FIELD OF THE INVENTION

The present invention is generally directed to counterfeit prevention for sensitive documents and, more particularly, to an improved security document which has a temperature sensitive feature.

BACKGROUND OF THE INVENTION

In the past, there have been many ways of attempting to prevent unauthorized duplication of important or sensitive documents. The development of xerography, and particularly color xerography, has provided the unscrupulous with the means for unauthorized duplication of original documents for the purpose of passing them off, with or without alteration, as an original document of the same kind. As a result of color xerography, the mere printing of an important document with a colored background is insufficient for preventing unauthorized duplication.

In fact, the problem is widespread and well known to the issuers of such original documentation which has led to considerable attention being given to ways to prevent the duplication of such documents by color xerography. While in no sense limited in practice, the documents will be understood to be of the type which include negotiable instruments, title instruments, identification instruments, and other similar security instruments or documents.

Because of these problems, there has been much attention given to the prevention of effective duplication of such documents by color xerography. It has become known, for instance, that xerographic copiers have a screen value, or dot frequency, threshold above which the copier is unable to distinguish the individual elements of the dot pattern of half-tone printing and that, as to color xerography, there are also spectral ranges of color in which the reproductive capability of the copier is relatively impaired. As a result of this knowledge of color xerography, the focus has been on using these facts to render unauthorized xerographic duplication difficult.

Typically speaking, the primary focus has been upon causing invalidating indicia of tampering to be essentially latent to the naked eye looking at the original document without the aid of magnification but to appear boldly in the xerographic copy.

In most earlier proposals, the invalidating indicia are printed in one dot frequency or screen value and the background is printed in another with the indicia camouflaged in one of a couple of different ways. In particular, this is achieved either with an intermediate third-dot frequency immediately surrounding the invalidating indicia or with a covering overlay of extraneous pattern intended to confuse the eye sufficiently to render the warning indicia indiscernible to ordinary observation. More recently, the invalidating indicia and the background have been printed in different screen values, one above and one below the dot frequency threshold of a xerographic copier, with the invalidating indicia as a compact all over pattern serving as its own camouflage.

While all of these techniques have their merits, there are certain important drawbacks that are inherent in each of them. These include the fact that there are continuously new improvements in the field of color xerography whereby exact reproductions of the original documents are or may become possible, i.e., the invalidating indicia may not appear in the xerographic copy. In order to keep pace, it is important to develop an improved security document that is independent of color xerography characteristics.

The present invention is directed to overcoming one or more of the foregoing problems and achieving one or more of the resulting objects.

SUMMARY OF THE INVENTION

It is a principal object of the present invention to provide an improvement in security or protected documents. More specifically, it is an object of the present invention to provide a security or protected document which has temperature sensitive characteristics. It is a further object of the present invention to provide a temperature sensitive color background for a security or protected document.

Accordingly, the present invention is generally directed to an improvement in security or protected documents. The security document comprises a substrate having both top and bottom surfaces where at least one of the surfaces is adapted to have printed copy thereon. A colored background is printed on at least a portion of the one of the surfaces adapted to carry the printed copy by using a temperature sensitive ink. The security document also includes copy which is printed on at least a portion of the one of the surfaces adapted to carry printed copy thereon. In particular, the copy is printed on the surface of the security document substrate by utilizing temperature insensitive ink.

In an exemplary embodiment, at least the top surface of the security document substrate is adapted to carry printed copy thereon. The printed copy preferably comprises indicia which is specific to the improved security document, and it is also advantageous for the temperature sensitive ink of the colored background to be such as to appear a first distinct color at and below a preselected temperature and a second distinct, contrasting color above that temperature. In the preferred embodiment, the colored background is suitably printed on the entirety of the top surface of the security document substrate.

In one highly preferred embodiment, a portion of the colored background is printed utilizing the temperature sensitive ink and the remainder of the colored background is printed utilizing a temperature insensitive ink. It is particularly advantageous for the copy in this embodiment to be printed over the colored background and to include indicia specific to the improved security or protected document utilizing a temperature insensitive ink of a third distinct color. With the preselected temperature an ambient less than body temperature, the second distinct color appears where the temperature sensitive ink has been used upon subjecting the substrate to body temperature.

In another respect, the colored background printed on the top surface preferably has the temperature sensitive ink only in a preselected area and the temperature insensitive ink in the remaining area thereof. This makes it possible for either the preselected area or remaining area to be in the form of validation indicia which will appear only whenever the top surface is exposed to a temperature at or above the preselected temperature. Still additionally, the colored background is preferably printed on the top surface of the substrate using the temperature sensitive and insensitive inks in a less than full-tone manner to produce a mottled pattern.

In one embodiment, the first distinct color which the colored background appears is a color other than white, and the second distinct color which the colored background appears is white. In another embodiment, the first distinct color which the colored background appears is other than white, and the second distinct color which the colored background appears is also other than white.

Advantageously, the temperature sensitive and insensitive inks are such as to cause the colored background on the substrate to be entirely uniform to the eye whenever the substrate is at and below the preselected temperature. This makes it impossible for the unscrupulous possible duplicator of the document by color xerographic means to even necessarily be aware of the security technique being employed, much less discerning the validating indicia thereon. In this connection, the security or protected document is such that one of the areas is in the form of a camouflaged validation indicia which appears only whenever the top surface is exposed to a temperature above the preselected temperature.

Other objects, advantages and features of the present invention will become apparent from a consideration of the following specification, taken in conjunction with the accompanying drawings.

DETAILED DESCRIPTION OF THE PREFERRED EMBODIMENT

Figure 1:
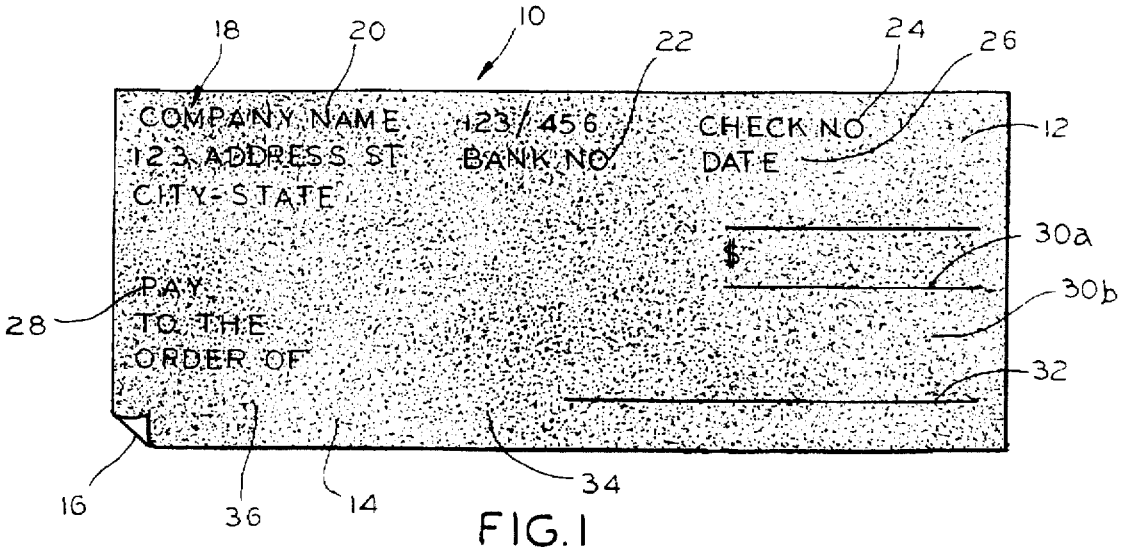
FIG. 1 is a security document as it would normally appear in accordance with the present invention.

In the illustrations given, and with reference first to FIG. 1, the reference numeral 10 designates generally an improved security document according to the present invention. The security document 10 comprises a substrate 12 having top and bottom surfaces 14 and 16 (see the folded corner) where at least the top surface 14 is adapted to carry printed copy such as 18, including indicia specific to the improved security document 10. As will be appreciated from the drawings, and with reference specifically to FIG. 1, the security document 10 that has been illustrated is in the form of a conventional check.

In the case of a check, the printed copy will comprise, for example, a company name and address as at 20, a bank name as at 22, a check number as at 24, a date area as at 26, a payee area as at 28, amount areas as at **30*a* and 30*b*, a payor signature line as at 32, and account indicia as at 34**, although the specifics of the printed copy can take any form that is required with those shown being merely illustrative.

Figure 2:
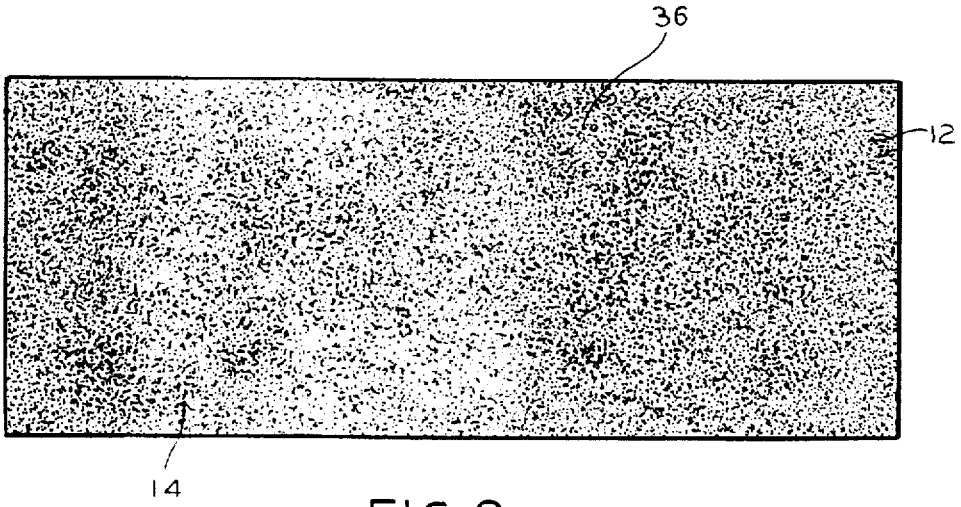
FIG. 2 is a security or protected document similar to FIG. 1 but without printed copy thereon.

Referring to FIGS. 1 and 2, the security document 10 will be understood to include a colored background 36 printed on the top surface 14 of the substrate 12 using a temperature sensitive ink. The temperature sensitive ink advantageously appears as a first distinct color at and below a preselected temperature and appears as a second distinct and contrasting color above the preselected temperature. In the illustrated embodiment shown in FIGS. 1 and 2, it will be seen that the colored background 36 is printed on the entirety of the top surface 14 (see, particularly, FIG. 2).

Figure 3:
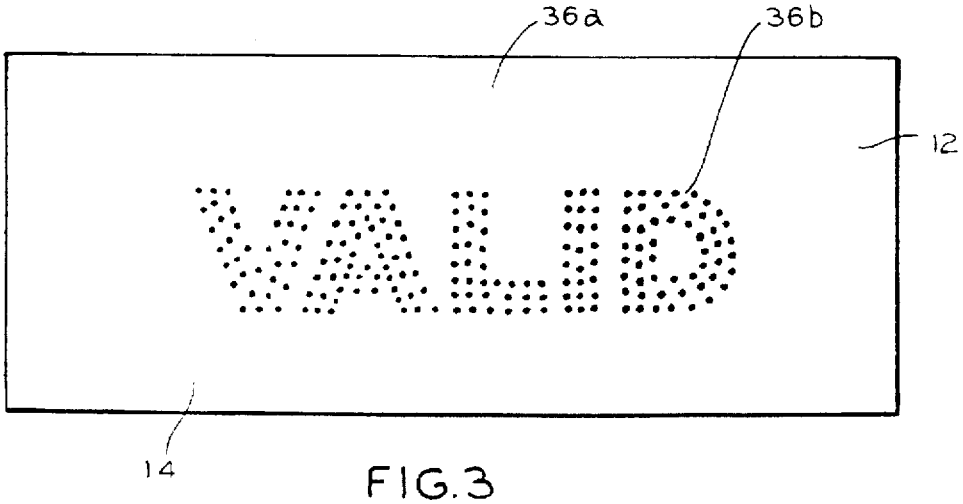
FIG. 3 is a security document similar to FIG. 2 that has been subjected to an elevated temperature.

By comparing FIGS. 2 and 3, the security document 10 can advantageously be seen to have the colored background 36 printed on a portion **36*a* using the temperature sensitive ink and on the remainder 36*b* using a temperature insensitive ink. It will be appreciated that FIG. 3 shows the substrate 12 (without the copy 18) after it has been subjected to an elevated temperature, i.e., a temperature sufficient to cause the temperature sensitive ink on the portion 36*a* of the colored background 36 to change from the first distinct color to the second distinct and contrasting color. In FIG. 1, the copy 18 has been printed over the colored background 36, preferably using a temperature insensitive ink of a third distinct color, so there is always a contrast between the printed copy 18 and the remainder of the top surface 14 of the substrate 12**.

As will be appreciated from FIGS. 2 and 3, the colored background 36 printed on the top surface 14 has the temperature sensitive ink only in a preselected area **36*a* thereof and the temperature insensitive ink in the remaining area 36*b* thereof. This makes it possible for one of the areas 36*a* and 36*b* to be in the form of validation indicia, such as the illustrated word "VALID" (or any other chosen word, code, or symbol), which appears whenever the top surface 14 of the substrate 12** is exposed to a temperature which is at or above the preselected temperature. In the preferred embodiment, the preselected temperature is an ambient less than body temperature such that the second distinct color for the temperature sensitive ink appears whenever the substrate is subjected to a temperature at least as great as body temperature.

Also, in the preferred embodiment, the first distinct color which the colored background appears as at **36*a* is a color other than white, and the second distinct color which the colored background appears as at 36*a* is white. It is also believed to be advantageous for the colored background 36 to be printed on the top surface 14 of the substrate 12 using the temperature sensitive and insensitive inks as at 36*a* and 36*b*, respectively, in a less than full tone manner to produce a mottled pattern. In an alternative embodiment, the first distinct color which the colored background appears as at 36*a* is other than white, and the second distinct color which the colored background appears as at 36*a*** is also other than white.

Referring specifically to FIG. 2, it will be seen and appreciated that the temperature sensitive ink and the temperature insensitive ink cause the colored background 36, i.e., the backgrounds as at **36*a* and 36*b*, to be entirely uniform to the eye when the substrate 12 is at or below the preselected temperature. It will further be appreciated, of course, that the colored background 36, in the preferred embodiment, is printed on the top surface 14 to have the temperature sensitive ink in any preselected area thereof (not just the area 36*a* which has been shown merely for purposes of illustration) and, likewise, to have the temperature insensitive ink in the remaining area thereof (not just the area 36*b* in the illustrated embodiment). With this understanding, the security document 10 may have the areas 36*a* and 36*b* arranged to form a camouflaged indicia (such as the word "VALID") which appears only when the top surface of the substrate 12** is exposed to a temperature above the preselected temperature.

From the foregoing, it is believed that the unique aspects and advantages of the present invention will now be fully appreciated by those skilled in the art of security or protected documents. The temperature insensitive inks can be of any conventional type which are well known in the art, and, in addition, the temperature sensitive ink, which can either be in the form of a disappearing background or a color changing background, can be a flexographic ink which incorporates a pigment that becomes invisible or changes color when heated and reappears when cooled. By way of example and not limitation, the flexographic ink may incorporate a pigment such as that sold under the registered trademark ChromaZone by Davis Liquid Crystals, Inc., of San Leandro, Calif. By reason of the characteristics of a temperature sensitive ink, i.e., the unique ability to become invisible or to change color when heated and then reappear when cooled, it is a virtual impossibility to successfully produce an unauthorized duplication of a security document.

Most certainly, color xerography is entirely ineffective in any attempted production of counterfeit security or protected documents. The recipient of a document attempting to be passed off as an authentic security document will immediately discover the existence of a color xerographic copy inasmuch as the colored background will not be temperature sensitive, i.e., upon applying pressure with a thumb and forefinger, the colored background will either fail to disappear or change color. In addition, the security or protected document is entirely capable of successfully utilizing a protection feature that may be fully customized for any particular application.

As previously discussed, the colored background 36 may be printed on the top surface 14 of the substrate 12 by utilizing a temperature sensitive ink in a preselected area such as 36*a* and a temperature insensitive ink in the remaining area, such as 36*b* thereof. It has been shown in very general terms that this could be done to incorporate a hidden validation indicia such as the enlarged word "VALID," although it is possible to provide serial numbers, expiration dates, key codes, or other indicia and to do so where such indicia have a specific relationship either to a series of security documents issued to be valid only for selected time periods or where the indicia is keyed to a specific location on the document. While these are matters of design to be selected for each particular security or protected document, the enormous flexibility that is provided by the invention will now be apparent from the foregoing description.

Without question, the basic concept of utilizing a temperature sensitive ink that is printed as a colored background is unique. It makes it entirely within reach to create improved security or protected documents that will make it possible to stay ahead of the unscrupulous who would otherwise continue attempts to create counterfeits thereof. As a result, the present invention will now be understood to provide an improvement that is unparalleled in the security document industry.

While in the foregoing there have been set forth preferred embodiments of the invention, it will be appreciated that the details herein given may be varied by those skilled in the art without departing from the true spirit and scope of the appended claims.

What is claimed is:

1. An improved security document, comprising:

a substrate having top and bottom surfaces where at least said top surface is adapted to carry printed copy including indicia specific to said improved security document;

a colored background printed on at least a portion of said top surface of said substrate using a temperature sensitive ink, said colored background appearing a first distinct color every time said top surface is exposed to a temperature at and below a preselected temperature and appearing a second distinct color every time said top surface is exposed to a temperature above said preselected temperature, said colored background thereby being permanently reversible between said first distinct color and said second distinct color; and copy printed over said colored background including indicia specific to said improved security document using a temperature insensitive ink of a third distinct color so as to always be visible whether said colored background appears said first distinct color or said second distinct color.

2. The improved security document of claim 1 wherein said colored background is printed on the entirety of said top surface with a portion using said temperature sensitive ink and the remainder using a temperature insensitive ink.

3. The improved security document of claim 2 herein said colored background printed on said top surface has said temperature sensitive ink in a preselected area thereof and said temperature insensitive ink in the remaining area thereof.

4. The improved security document of claim 3 wherein one of said preselected area and remaining area are in the form of validation indicia which appear whenever said top surface is exposed to a temperature above said preselected temperature.

5. The improved security document of claim 1 wherein said colored background is printed on said portion of said top surface of said substrate using said temperature sensitive ink in a less than full-tone manner to produce a mottled pattern.

6. The improved security document of claim 1 wherein said preselected temperature is an ambient less than body temperature such that said second distinct color appears whenever said substrate is subjected to body temperature.

7. An improved security document, comprising:

a substrate having top and bottom surfaces where at least said top surface is adapted to carry printed copy including indicia specific to said improved security document;

a colored background printed on said top surface of said substrate using a temperature sensitive ink, said colored background appearing a first distinct color every time said top surface is exposed to a temperature at and below a preselected temperature and appearing a second distinct and contrasting color every time said top surface is exposed to a temperature above said preselected temperature such that said colored background is thereby permanently reversible between said first distinct color and said second distinct color, said colored background being printed on the entirety of said top surface with a portion using said temperature sensitive ink and the remainder using a temperature insensitive ink; and copy printed over said colored background including indicia specific to said improved security document using a temperature insensitive ink of a third distinct color so as to always be visible whether said colored background appears said first distinct color or said second distinct color;

said preselected temperature being an ambient less than body temperature such that said second distinct color appear whenever said substrate is subjected to body temperature.

8. The improved security document of claim 7 wherein said colored background printed on said top surface has said temperature sensitive ink in a preselected area thereof and said temperature insensitive ink in the remaining area thereof.

9. The improved security document of claim 8 wherein said one of said preselected area and remaining area are in the form of validation indicia which appear whenever said top surface is exposed to a temperature above said preselected temperature.

10. The improved security document of claim 7 wherein said colored background is printed on said top surface of said substrate using said temperature sensitive and insensitive inks in a less than full-tone manner to produce a mottled pattern.

11. The improved security document of claim 7 wherein said first distinct color which said colored background appears is a color other than white and wherein said second distinct color which said colored background appears is white.

12. The improved security document of claim 7 wherein said first distinct color which said colored background appears is other than white and wherein said second distinct color which said colored background appears is also other than white.

13. The improved security document of claim 7 wherein said temperature sensitive ink and said temperature insensitive ink cause said colored background to be entirely uniform to the eye when said substrate is at and below said preselected temperature.

14. The improved security document of claim 13 wherein said colored background printed on said top surface has said temperature sensitive ink in a preselected area thereof and said temperature insensitive ink in the remaining area thereof.

15. The improved security document of claim 14 wherein one of said preselected area and remaining area are in the form of a camouflaged indicia which appears only whenever said top surface is exposed to a temperature above said preselected temperature.

16. An improved security document, comprising:

a substrate having top and bottom surfaces where at least one of said surfaces is adapted to carry printed copy thereon;

a colored background printed on at least a portion of one of said surfaces using a temperature sensitive ink, said temperature sensitive ink appearing a first distinct color every time it is exposed to a temperature at and below a preselected temperature and appearing a second distinct color every time it is exposed to a temperature above preselected temperature, said temperature sensitive ink thereby being permanently reversible between said first distinct color and said second distinct color; and copy printed on at least a portion of said one of said surfaces of said substrate using a temperature insensitive ink therefor.

17. The improved security document of claim 16 wherein said one of said surfaces of said substrate is a top surface and said copy printed on said top surface of said substrate is indicia specific to said improved security document.

18. The improved security document of claim 16 wherein said colored background is printed on said top surface of said substrate and said printed copy is printed over said colored background using said temperature insensitive ink.

19. The improved security document of claim 16 wherein said colored background is printed on the entirety of said one of said surfaces with a portion using said temperature sensitive ink and the remainder using a temperature insensitive ink.

* * * * *

UNITED STATES PATENT AND TRADEMARK OFFICE

CERTIFICATE OF CORRECTION

PATENT NO. : 5,636,874

DATED : June 10, 1997

INVENTOR(S) : STEPHEN A. SINGER

It is certified that error appears in the above-identified patent and that said Letters Patent is hereby corrected as shown below:

column 6, line 9, please replace "herein" with --wherein--.

Signed and Sealed this

Twenty-third Day of September, 1997

*Attest:*

*Attesting Officer*

Bruce Lehman

BRUCE LEHMAN

*Commissioner of Patents and Trademarks*